United States Patent [19]

Kamei et al.

[11] 4,370,533

[45] Jan. 25, 1983

[54] KEYBOARD SWITCH AND PROCESS FOR PRODUCTION THEREOF

[75] Inventors: Seisuke Kamei, Nagano; Hideo Nabetani; Ryohei Kinoshita, both of Suzaka, all of Japan

[73] Assignee: Fujitsu Limited, Kawasaki, Japan

[21] Appl. No.: 213,402

[22] Filed: Dec. 5, 1980

[30] Foreign Application Priority Data

Dec. 10, 1979 [JP] Japan ..... 54/160030

[51] Int. Cl.[3] ..... H01H 3/12; H01H 13/52

[52] U.S. Cl. ..... 200/340; 200/5 A; 200/159 A; 200/159 B; 200/159 R

[58] Field of Search ..... 200/5 A, 159 A, 159 B, 200/159 R, 153 J, 340

[56] References Cited

U.S. PATENT DOCUMENTS

| | | | |
|---|---|---|---|
| 1,502,785 | 7/1924 | Kerwin | 200/153 J |
| 2,601,545 | 6/1952 | Miller | 200/153 J |
| 3,909,564 | 9/1975 | Scheingold et al. | 200/159 B |
| 4,029,916 | 6/1977 | Chu | 200/340 |
| 4,129,763 | 12/1978 | Murata | 200/159 A |
| 4,177,367 | 12/1979 | Tirone | 200/159 A |
| 4,207,448 | 6/1980 | Furusawa et al. | 200/159 B |

FOREIGN PATENT DOCUMENTS

| | | | |
|---|---|---|---|
| 882850 | 11/1961 | United Kingdom | 200/670 |

*Primary Examiner*—John W. Shepperd
*Attorney, Agent, or Firm*—Staas & Halsey

[57] ABSTRACT

A push-button switch has a housing in which is positioned a switch contact spring driven by the vertical movement of a drive rod comprised of a synthetic resin. The push-button switch further comprises a contact-driving plate spring portion constructed by a bent portion of a plate spring element. The drive rod is formed by mold processing using a support-portion of the plate spring element as a core, and the contact-driving plate spring portion is extended from the drive rod. The drive rod drives the switch contact spring through the contact-driving plate spring portion.

9 Claims, 21 Drawing Figures

KEYBOARD SWITCH AND PROCESS FOR PRODUCTION THEREOF

TECHNICAL FIELD

The present invention relates to a keyboard switch to be used for a data input-output terminal unit and a process for the production thereof.

BACKGROUND OF THE INVENTION

A keyboard is used for a terminal operation table, such as a typewriter or printer, and ordinarily comprises push-button switches arranged in the form of a matrix, and data are put in the keyboard by pushing the appropriate buttons on the keyboard.

Switches are divided into two types, that is, switches having a mechanical contact element, such as reed switches, and switches having a non-contact switch element such as hall IC. The present invention is directed to a keyboard comprising the former type, i.e., switches having a mechanical contact structure.

The present invention intends to provide keyboards at a low cost by improving the productivity of the assembly-flow production process, especially the switch-assembling step.

Conventional push-button switches for a keyboard are manufactured by preparing many parts separately and assembling them in a certain order. However, this assembling operation requires many steps, and therefore, tests and experiments need to be conducted many times during the assembling process to ensure accuracy and proper quality control. Moreover, according to the conventional assembling process, switch elements are attached one by one to a switch panel, and the assembling operation is very tedious.

SUMMARY OF THE INVENTION

It is therefore a primary object of the present invention to overcome these disadvantages involved in the conventional technique. More specifically, the primary object of the present invention is to provide the following embodiments in which the design structure of the switches is improved in various points so that the assembling operation is simplified and mechanized and a high productivity is ensured in the assembly-flow process.

In the switch of the present invention, the spring system for driving contacts is especially simplified, and the switch of the present invention comprises as the main structural parts a housing, a drive rod and a bottom plate portion including a contact mechanism therein.

More specifically, the keyboard switch according to the present invention is a push-button switch in which a drive rod comprised of a synthetic resin is vertically moved to drive a switch contact spring arranged in a housing. This push-button switch has a contact-driving plate spring (i.e. leaf spring) portion constructed by a bent portion of a plate spring element. The drive rod is formed by molding, with the main part of the plate (leaf) spring element being the core, and the contact-driving plate (leaf) spring portion extends from the drive rod. The mold body drives the switch contact spring through the contact-driving plate spring portion.

DETAILED DESCRIPTION OF THE PREFERRED EMBODIMENTS

Figure 1:
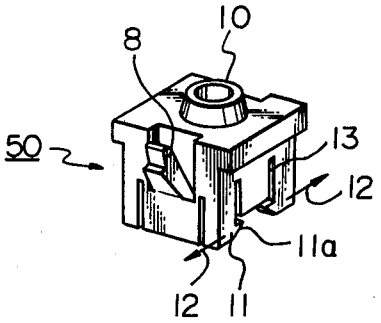
FIG. 1 is a perspective view showing a housing proper of the keyboard switch according to the present invention.

Referring to FIG. 1, a housing proper 50 is an insulating casing formed by molding a plastic material. Claws 8 are formed on both the side faces of the housing proper 50 (only the claw 8 on one side face is shown), and a hole 10 for inserting a drive rod 51 (see FIG. 2)

from below is formed on the housing proper 50. A claw 11 having an inclined face 11*a* is formed on the bottom portion of the housing, and a slit 13 is formed so that this claw 11 is opened outward (in a direction of arrow 12). The claw 11, its inclined face 11*a* and slit 13, exerts a function of facilitating the insertion and assembling of a bottom plate 52 (see FIG. 3).

Figure 2:
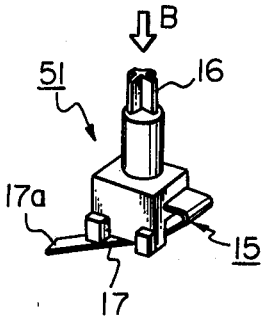
FIG. 2 is a perspective view showing a drive rod of the keyboard switch according to the present invention.

Referring to FIG. 2, the drive rod 51 is formed by insert molding of a plate spring element 15. A support-portion 15*a* of the plate spring element 15, having a shape as shown in FIG. 4, is used as the core of the molded body, and an upper portion 16 is the shaft on which a key top (not shown in FIG. 4) is inserted. The molded body shown in FIG. 2 is moved downward (in a direction of arrow B) by the keying operation of the key top to act on an actuator 19 (FIG. 3) mounted on the bottom plate 52 of the keyboard switch. A plate spring portion 17 has a driving point 17*a*, as shown in FIG. 4.

Figure 3:
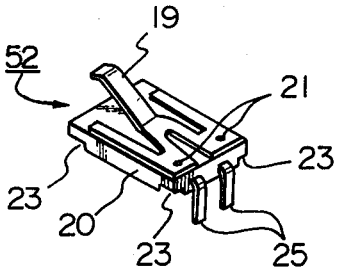
FIG. 3 is a perspective view showing a housing bottom plate of the keyboard switch according to the present invention.
Figure 4:
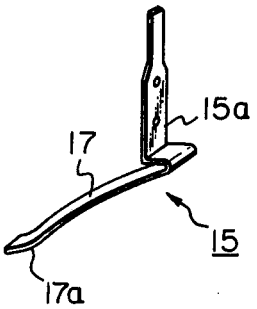
FIG. 4 is a perspective view showing a plate spring element of the keyboard switch according to the present invention.

FIG. 3 shows a housing bottom portion, including a contact mechanism therein of the keyboard switch. The actuator 19 is formed by punching out an elastic board in the form shown in FIG. 3 and is fixed and secured to a heat-fitting point 21 of a bottom plate 20 of a molded plastic body. A contact mechanism for opening or closing a contact by utilizing the reversing movement of a dome spring (corresponding to a member 54 shown in FIG. 7) is disposed below the central portion of the actuator.

Notches 23 are formed at four corners of the bottom plate 52 so that they are engaged with the claw 11 of the housing proper 50 and the bottom plate 52 is prevented from falling down during ordinary operation after assembling. When the switch is assembled, the drive rod 51 is first inserted into the housing proper 50, and then, the bottom plate 52 of the housing is inserted from below, whereby the bottom plate 52 presses the inclined face 11*a* of the claw 11 of the housing proper 50 to open the claw 11 and the bottom plate 52 is secured to the housing proper 50.

Figure 5:
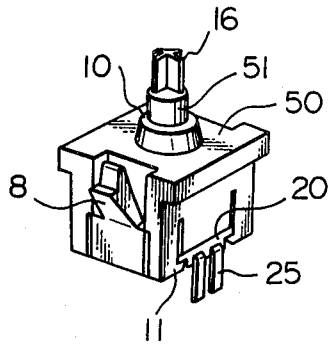
FIG. 5 is a perspective view showing the structural elements shown in FIGS. 1, 2 and 3 assembled to form the keyboard switch according to the present invention.
Figure 6:
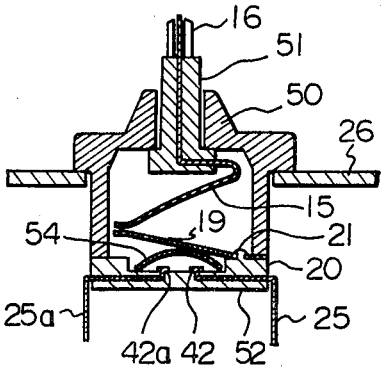
FIG. 6 is a view showing the longitudinal section of the central portion of the switch shown in FIG. 5.

FIG. 5 is a perspective view showing the state in which the three main structural elements 50, 51 and 52 shown in FIGS. 1, 2 and 3 are assembled, and FIG. 6 is a view showing the section of the central portion of the assembly.

The so constructed push-button switch performs the operation of opening and closing contacts according to the following procedures.

The key top (not shown) mounted on the drive rod 51 from above is pushed to displace the drive rod 51 and cause the actuator 19 to press down the top of the dome spring 54, whereby the dome spring 54 is turned over and contacts 42 and 42*a* formed on the bottom plate 52 are closed to render conductive the region between external terminals 25 and 25*a* located on both sides of the bottom plate. When the press-down operation is released, the dome spring 54 is restored to the original state shown in the drawings and the contacts are opened.

Figure 7:
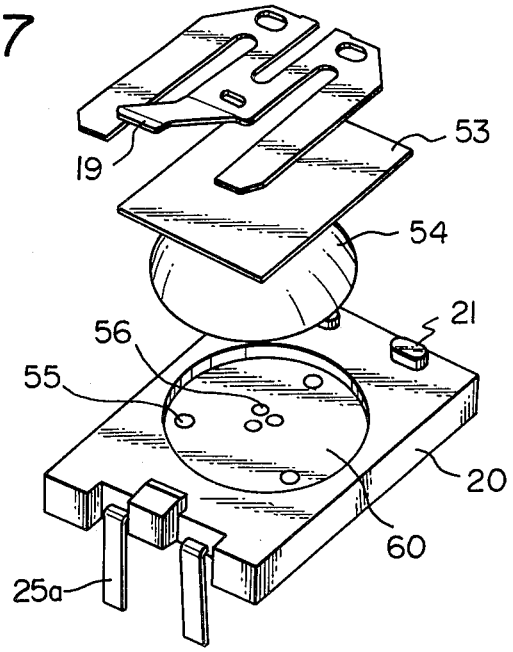
FIG. 7 is a fragmentary perspective view showing one embodiment of the housing bottom plate of the keyboard switch according to the present invention.
Figure 8:
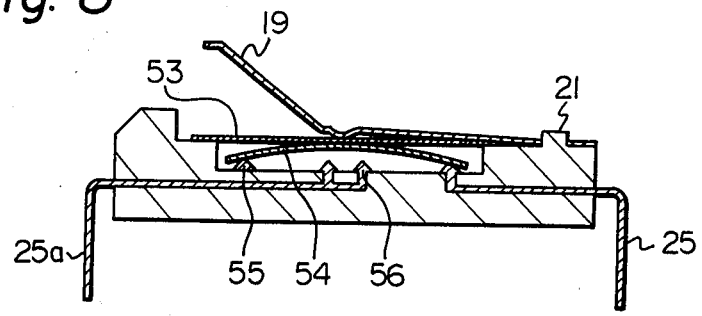
FIG. 8 is a sectional view showing the assembling state of the housing bottom plate shown in FIG. 7 in which the contact is opened.
Figure 9:
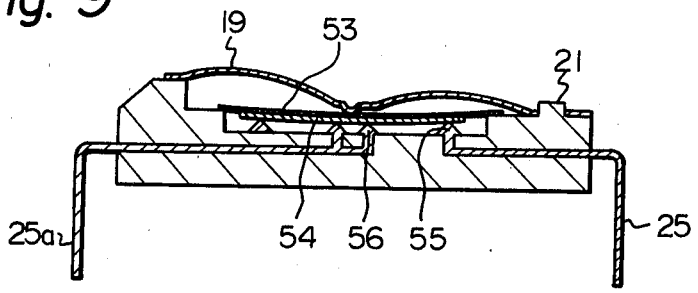
FIG. 9 is a sectional view showing the assembling state of the housing bottom plate shown in FIG. 7 in which the contact is closed.

FIG. 7 is a fragmentary perspective view showing another embodiment of the bottom plate. The actuator 19 is arranged on the dome spring 54 through an insulating sheet 53. A circular dent 60 is formed on a bottom plate member 20. In this circular dent 60, three projecting contacts 56 are formed in the central portion and another three projecting contacts 55 are formed in the peripheral portion. The central projecting contacts 56 are electrically communicated with, for example, one of four external terminals 25*a*, and the three peripheral projecting contacts 55 are electrically communicated with one another and with the remaining three external terminals 25. Connection among the contacts and terminals is not limited to the one illustrated in the drawings, but other connections may be adopted. While the actuator 19 is not operated, the external terminals 25*a* are insulated from the external terminals 25 as shown in FIG. 8. When the actuator 19 is operated, the external terminals 25 and 25*a* are electrically communicated with one another through the dome spring 54 as shown in FIG. 9.

Figure 10:
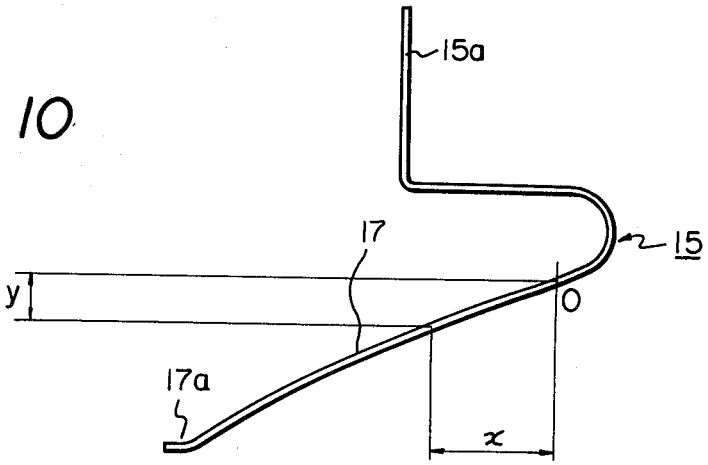
FIG. 10 is a diagram illustrating the shape of the plate spring element of the keyboard switch according to the present invention.

The shape of the plate spring portion of the plate spring element 15 will now be described. As shown in FIG. 4, the plate spring portion 17 is preferably formed to have a slightly convex shape toward the upper direction. If such a shape is adopted for the plate spring portion 17, when the plate spring element 15 is pressed from above, the driving point 17*a* of the plate spring portion 17 is always held at the position of the top end of the plate spring portion 17. If the plate spring portion has a linear or concave shape, when the plate spring element 15 is pressed from above, the driving point 17*a* of the plate spring portion 17 is gradually shifted toward the center. The degree of convex curving of the plate spring portion 17 is preferably adjusted so that when the plate spring element is pressed, the plate spring portion becomes linear. Sizes of one actual example of such a shaped spring portion are shown in the following Table with further reference to FIG. 10. In this example, the thickness of the plate spring portion is 0.18 mm, the Young's modulus is 19,500 Kg/mm$^2$, the width of the starting point (point 0 in FIG. 10) of the plate spring portion 17 is 4.1 mm, and the width of the driving point 17*a* is 2.6 mm. The portion from the point 0 to the point 17*a* in FIG. 10 is divided into 8 equal parts and the values of both the coordinates x and y at each point are calculated and shown in the following table.

| Point | x | y |
|---|---|---|
| 0 | 0 mm | 0 mm |
| 1 | 1.5 mm | 0.04 mm |
| 2 | 3.0 mm | 0.17 mm |
| 3 | 4.5 mm | 0.37 mm |
| 4 | 6.0 mm | 0.64 mm |
| 5 | 7.5 mm | 0.96 mm |
| 6 | 9.0 mm | 1.32 mm |
| 7 | 10.5 mm | 1.73 mm |
| 8 | 12 mm | 2.14 mm |

In the switch according to the present invention, the claw 11 is formed on the bottom of the housing proper 50, the slit 13 for opening outward the claw 11 is formed on the side face of the housing proper 50, and a notch 23 to be engaged with the claw 11 is formed on the housing bottom plate portion 52. This switch is a keyboard switch which can be easily assembled. Furthermore, the drive rod 51 of the keyboard switch is formed by molding, using the plate spring element as the core, and the exposed plate spring portion has a convex curved shape. Therefore, spring-stiffness of this switch is stable on full stroke and the plate spring member is securely fixed to the drive rod. Therefore, a contact-driving action having an enhanced reliability can be obtained.

The process for the production of the above-mentioned keyboard switch will now be described.

According to one embodiment, projections are formed at certain predetermined pitches on a web-like metal frame, and these projections are subjected to insert molding to form the housings proper at predetermined pitches. Drive rods and contact mechanism-supporting bottom plates are continuously assembled to the respective housings proper to form keyboard switches continuously. This embodiment will now be described in detail with reference to FIGS. 11 through 15.

Figure 11:
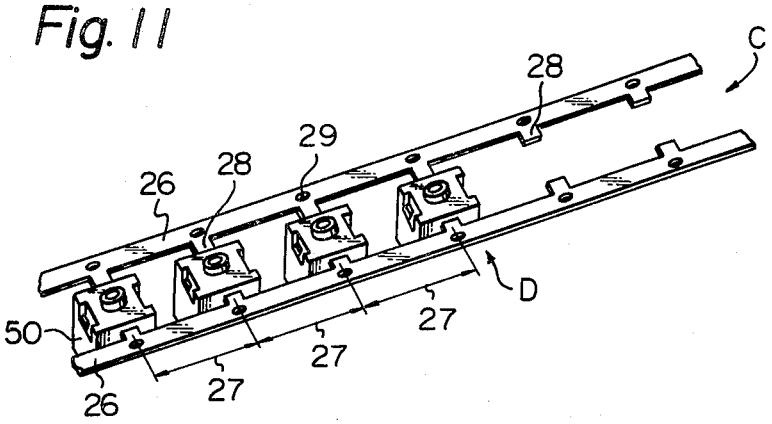
FIG. 11 is a perspective view showing the process of forming the housing proper according to the present invention of the process.
Figure 12:
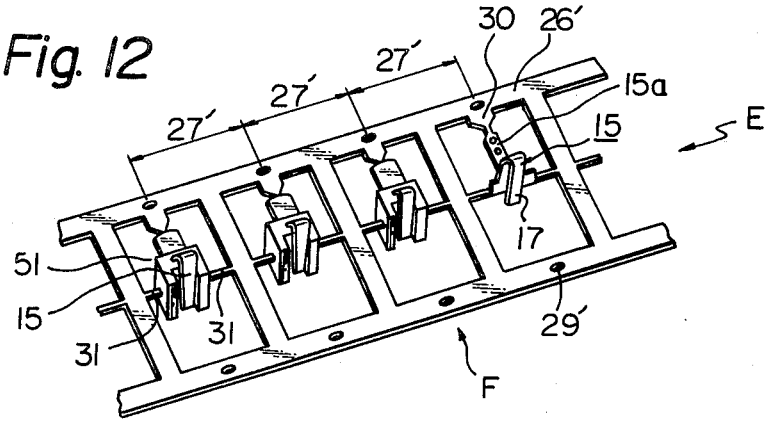
FIG. 12 is a perspective view showing the process of forming the drive rod according to the present invention of the process.
Figure 13:
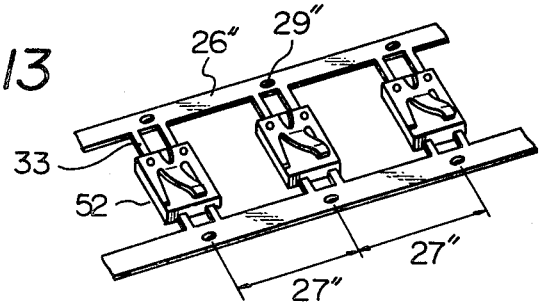
FIG. 13 is a perspective view showing the process of forming the housing bottom plate according to the present invention of the process.

FIGS. 11, 12 and 13 are perspective views showing the housing proper 50, drive rod portion 51 and contact mechanism-supporting bottom plate portion 52, respectively, which are formed on continuous frames 26, 26' and 26''. The member-arranging pitches 27, 27' and 27'' are made equal to one another, whereby it becomes possible to assemble a plurality of switches collectively in a continuous manner.

For this purpose, standard projections 28 (see FIG. 11) or position-indicating members having a similar function are formed at predetermined pitches on the respective frames 26, 26' and 26'' to maintain a high dimension precision for the pitches 27, 27' and 27'' of the respective members.

The operation of molding the housing in FIG. 11 is performed by using a molding machine, for example, an injection molding machine. The above-mentioned projections 28 are inserted and embedded in the mold of the molding machine so that housings 50 are formed at predetermined arrangement pitches. Reference numerals 29, 29' and 29'' represent holes for sprockets for automatic feeding of the frames. The frame 26 is transferred in a direction of arrow C (see FIG. 11), and the housings proper are continuously molded at pitches corresponding to those of the projections 28 by the molding machine (not shown) disposed at the position D.

Referring to FIGS. 12 and 13, frame projections 30 and 33, similar to the above-mentioned projections 28, are formed, at the same pitches as those of the projections 28, on the frames 26' and 26'', respectively.

In FIG. 12, prior to the molding operation, the plate spring element 15 is formed integrally with the frame 26' as shown in the drawings. More specifically, this plate spring element 15 is formed by punching out the frame 26' in a predetermined shape and subjecting the plate spring portion 17 to a bending process. The frame 26', having the so-formed plate spring elements 15, is transferred in a direction of arrow E and by a molding machine (not shown) disposed at the position F, drive rods 51 are continuously molded, with the support-portion 15*a* of the plate spring element 15 being as the core. For this purpose, a spring material such as stainless steel is selected and used as the frame 26'. The frame projections 30 act not only as members for keeping constant pitches for the drive rods, but also as members for connecting the plate spring elements 15. The molded drive rods 51 are held on the frame 26' by frame bars 31 disposed on both sides of the rods and between the outer longitudinal portions of the frame 26'.

The projections of the so formed drive rods are cut out and the drive rods are raised vertically to the plain face of the frame 26' for facilitating the assembling operation. Then, the drive rods are inserted into the housings proper (see FIG. 11) from below, and a predetermined number of the drive rods are collectively assembled with the housings proper. Frame bars 31 (two bars disposed on both sides, respectively) are cut out before completion of the insertion of the drive rods. Then, the bottom plate members 52 are assembled in the same manner as described above, whereby the assembling of switches according to the present invention is completed.

Referring to FIG. 13, projections 33 formed at predetermined pitches on the frame 26'' supporting the bottom plate 52 are cut and bent at a right angle to form external terminals.

Figure 14:
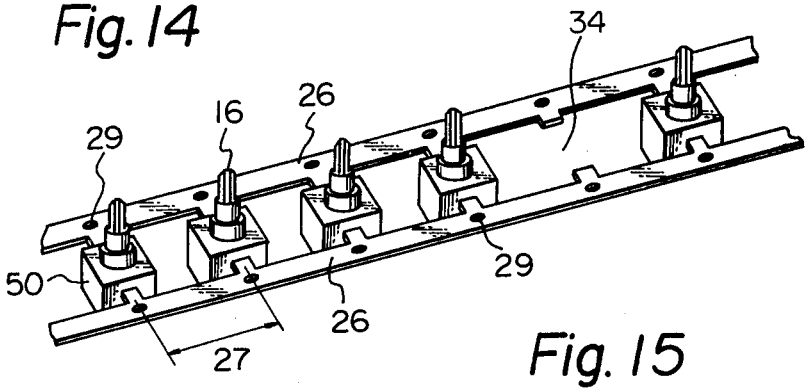
FIG. 14 is a perspective view showing the process of assembling the keyboard switch according to the present invention of the process.
Figure 15:
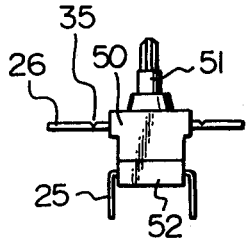
FIG. 15 is a side view of the keyboard switch shown in FIG. 14.

A predetermined number of switches assembled continuously in the above-mentioned manner are shown in the perspective view of FIG. 14. In FIG. 14, the portion 34 where a switch is not present is to be removed as a defective portion, and removal of the defective portion 34 is accomplished by cutting the notched portion 35 shown in the side view of FIG. 15. The switches are then further fed to a station where the step of testing their characteristic or quality is performed. Since the frame is kept continuous even after the assembling operation, the testing can be performed automatically.

Figure 16:
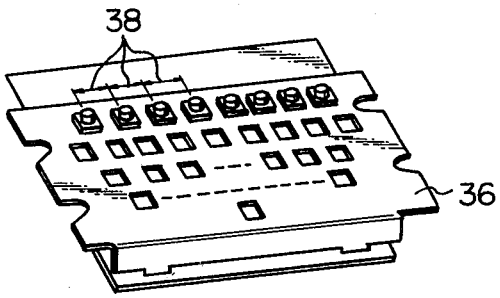
FIG. 16 is a perspective view illustrating one embodiment of the keyboard switch assembling process according to the present invention.

A portion of the frame on which an appropriate number of switches have been assembled, as shown in FIG. 14, is cut out and attached to a keyboard. This state is shown in the perspective view of FIG. 16. In FIG. 16, the switches are attached to the uppermost row of a panel 36.

If the switch attachment pitches 38 are made equal to the above-mentioned pitches 27, the assembling operation can further be simplified and the operation efficiency can be enhanced.

Figure 17:
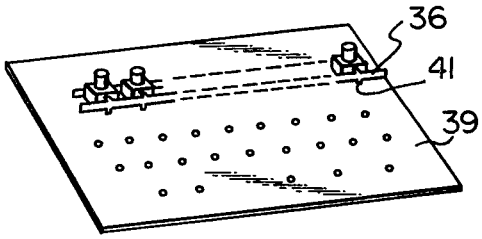
FIG. 17 is a perspective view illustrating another embodiment of the keyboard switch assembling process according to the present invention.
Figure 18:
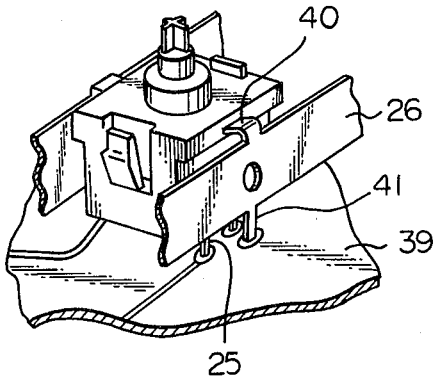
FIG. 18 is view showing parts of the keyboard switch shown in FIG. 17 in detail.

FIG. 17 shows another embodiment of the process for assembling a keyboard according to the present invention, which is different from the embodiment shown in FIG. 14. FIG. 18 is an enlarged perspective view showing the single switch in the keyboard shown in FIG. 17. Referring to FIGS. 17 and 18, the frame 26 is formed with a terminal 41 thereon used for attachment of switches to a printed board substrate, and the frame 26 is subjected to bending processing at the point 40 shown in FIG. 18. The printed board substrate-attaching terminal 41 formed on the edge portion of the frame 26 is inserted into a through hole of the printed board substrate 39 and is fixed onto the back face of the substrate by bending or soldering.

According to this attachment method, since the keyboard switch assembly is assuredly secured and held on the printed board substrate 39 by means of the frame 26, the panel 36 acting as the keyboard switch fixing frame, as shown in FIG. 16, need not be used, and it is sufficient if only the assembly is covered by a decorative plate (not shown).

As will be apparent from the foregoing description, according to the present invention, all the manufacturing process steps from the switch-forming step to the keyboard-assembling step can be performed automatically by utilizing still another embodiment of the keyboard switch assembling continuous structure of the frame 26.

Figure 19:
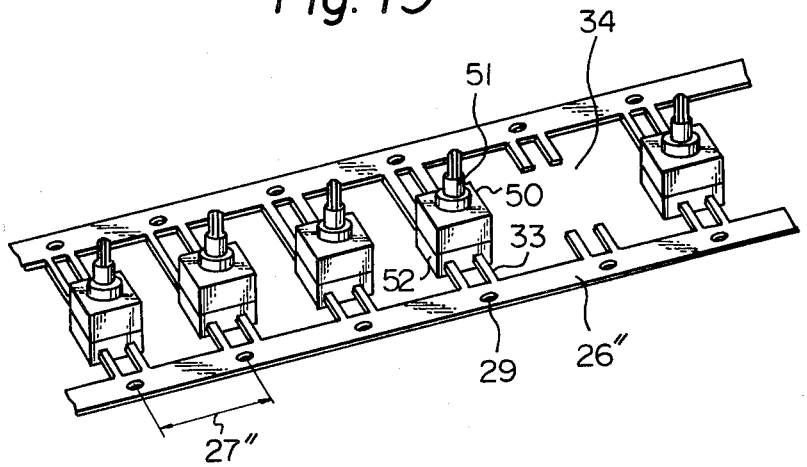
FIG. 19 is a perspective view illustrating still another embodiment of the keyboard switch assembling process according to the present invention.

According to the process of the present invention, as shown in FIG. 19 the switches may be assembled by attaching housings 50, including drive rods 51 therein, from above to a frame 26'' on which bottom plates 52 are continuously formed, combining the assembled switches with a keyboard panel and, simultaneously, cutting off the terminal frame 26''.

Figure 20:
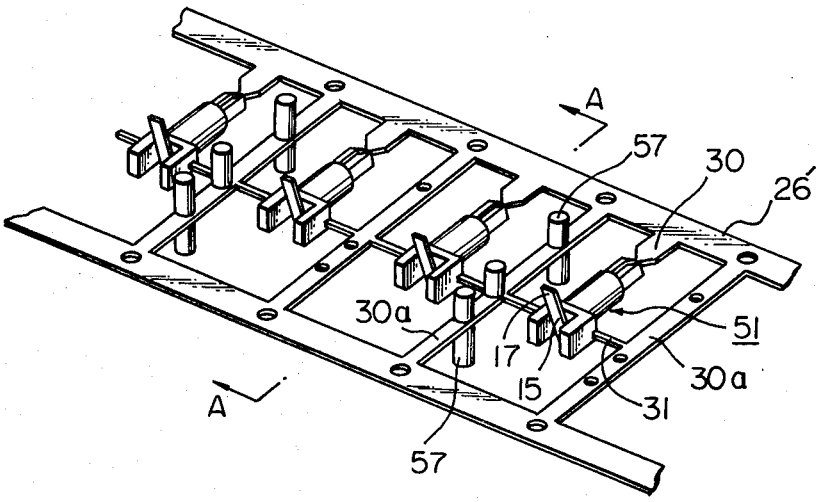
FIG. 20 is a perspective view showing another embodiment of the manufacturing process of the drive rod according to the present invention of the process.
Figure 21:
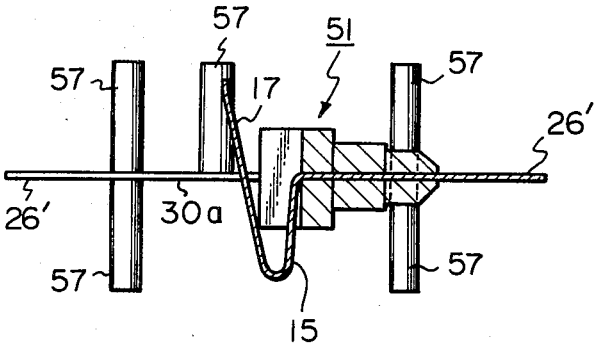
FIG. 21 is a view showing the section taken along the line A—A in FIG. 20.

FIG. 20 is a perspective view showing another embodiment of the frame 26' for forming drive rods 51, and FIG. 21 is a sectional view thereof. In this embodiment, projections 57 for protecting the plate spring portions 17 of the plate spring elements 15 are formed on a traverse bar 30*a* of the frame 26' at appropriate positions.

These projections 57 are formed of a synthetic resin by molding. If drive rods are formed on the frame having such plate spring-protecting projections, when great numbers of switch parts such as drive rods are delivered from the part-manufacturing plant to the switch assembling plant and when the drive rod frames are piled together or contained in a vessel, the plate spring portions 17 are prevented from falling in contact with other members or from being bent or undergoing elastic spring characteristics changes.

As will be apparent from the foregoing description, according to the present invention, the basic approach of assembling single switch units in the conventional technique has been drastically changed, and a number of switches can now be simultaneously prepared and assembled consistent and quickly. This is one of the prominent advantages attained by the present invention. Futhermore, if processes as illustrated in the foregoing embodiments of the invention are adopted for the assembling of keyboard devices, a significant reduction of the number of the assembling steps can be expected. Therefore, it becomes apparent substantial industrial advantages can be attained according to the present invention.

We claim:

1. A push-button switch having in a housing thereof a switch contact spring driven by the vertical movement of a drive rod which comprises: a plate spring element having an upwardly extending drive-rod support-portion and a bent switch contact spring-driving portion extending transversely downwardly from the drive-rod support portion of the plate element for engagement with the switch contact spring, wherein said drive rod is formed of a molded synthetic resin fixedly mounted around the support-portion of the plate spring element, and wherein said drive rod drives said switch contact spring through the switch contact spring-driving portion, the contact spring-driving portion further acting as a return spring for the drive-rod.

2. A push-button switch as set forth in claim 1, wherein the switch contact spring-driving portion of the plate spring element is formed of a convex curved shape toward the upper end connected to the drive-rod support portion of the plate spring element.

3. A push-button switch as set forth in claim 1, wherein the housing comprises a housing proper, a housing bottom plate, elastic claws formed on both sides of the housing proper to hold the housing bottom plate onto the housing proper at both sides of the housing proper, and wherein said claws are formed with an inclined face so that on asembling, said inclined faces of the claws are brought into butting contact with the housing bottom plate to open the claws.

4. A push-button switch comprising:

(a) a housing;

(b) a plate spring element movably positioned in the housing and having a substantially straight drive-rod support member and a bent switch-contact spring-driving member extending transversely from the drive-rod support member;

(c) a drive rod formed of a molded synthetic resin, fixedly mounted around the drive-rod support member of the plate spring element, and movably positioned in the housing; and (d) a switch contact spring member positioned in the housing and being engaged with the lower end of the switch-contact spring-driving portion of the plate spring element for being driven when the drive-rod is moved.

5. The push-button switch of claim 4, wherein the switch-contact spring-driving member of the plate spring element is formed in a convex curved shape toward the upper end connected to the drive-rod support member.

6. The push-button switch of claim 4 or 5, wherein the housing comprises a housing body for receiving the plate spring element and drive rod and a housing bottom plate for receiving the switch contact spring.

7. The push-button switch of claim 6, wherein elastic claws are formed on both sides of said housing body to hold the housing bottom plate onto the housing body and wherein said claws are formed with an inclined face so that on assembling said inclined faces of the claws are brought into butting contact with the housing bottom plate to open the claws.

8. The push-button switch of claim 7, wherein said housing bottom plate has a circular indentation with projecting contacts formed thereon, wherein said switch contact spring member comprises a dome spring positioned in the circular indentation of said housing bottom plate, an insulating sheet located on said dome spring, and a spring-actuated member affixed to said housing bottom plate on the top thereof for engagement with said switch contact spring-driving member of said plate spring element; and wherein external terminals are attached to said housing bottom plate and in electrical communication with the projecting contacts formed on said circular indentation of the housing bottom plate.

9. The push-button switch of claim 6, wherein said housing bottom plate has a circular indentation with projecting contacts formed thereon, wherein said switch contact spring member comprises a dome spring positioned in the circular indentation of said housing bottom plate, an insulating sheet located on said dome spring, and a spring-actuated member affixed to said housing bottom plate on the top thereof for engagement with said switch contact spring-driving member of said plate spring element; and wherein external terminals are attached to said housing bottom plate and in electrical communication with the projecting contacts formed on said circular indentation of the housing bottom plate.

* * * * *

UNITED STATES PATENT AND TRADEMARK OFFICE

CERTIFICATE OF CORRECTION

PATENT NO. : 4,370,533

DATED : Jan. 25, 1983

INVENTOR(S) : Kamei et al.

It is certified that error appears in the above-identified patent and that said Letters Patent is hereby corrected as shown below:

Column 3, line 21, after "Therein" insert --,--.
Column 5, line 49, after "being" insert --used--.
Column 6, line 53, delete "still another embodiment of the key-";
Column 6, line 54, "board switch assembling" should be --the--;
Column 6, line 56, "the" (first occurrence) should be --still another embodiment of the key-board switch assembling--.
Column 7, line 13, "of" should be --to--;
Column 7, line 16, "consistent" should be --consistently--.
Column 8, line 36, delete "8"; [correct spacing of margin];
Column 8, line 39, delete "8"; [correct spacing of margin].

Signed and Sealed this

Second Day of August 1983

[SEAL]

*Attest:*

GERALD J. MOSSINGHOFF

*Attesting Officer*

*Commissioner of Patents and Trademarks*